US005147748A

United States Patent [19]

Gitzel et al.

[11] Patent Number: 5,147,748

[45] Date of Patent: Sep. 15, 1992

[54] USE OF COLORLESS HIGHLY FLUORINE-SUBSTITUTED PHOSPHONIUM COMPOUNDS AS CHARGE CONTROL AGENTS FOR ELECTROPHOTOGRAPHIC RECORDING PROCESSES

[75] Inventors: Jörg Gitzel, Hattersheim am Main; Hans-Tobias Macholdt, Darmstadt; Wolfgang Knaup, Burgkirchen, all of Fed. Rep. of Germany

[73] Assignee: Hoechst Aktiengesellschaft, Frankfurt am Main, Fed. Rep. of Germany

[21] Appl. No.: 508,852

[22] Filed: Apr. 12, 1990

[30] Foreign Application Priority Data

Apr. 15, 1989 [DE] Fed. Rep. of Germany ..... 3912396

[51] Int. Cl.[5] ..... G03G 9/097

[52] U.S. Cl. ..... 430/110; 430/137

[58] Field of Search ..... 430/110, 111, 903, 904

[56] References Cited

U.S. PATENT DOCUMENTS

| | | | |
|---|---|---|---|
| 3,893,935 | 7/1975 | Jadwin et al. | 252/62.1 |
| 3,948,654 | 4/1976 | Fisher | 430/110 |
| 4,496,643 | 1/1985 | Wilson et al. | 430/110 |
| 4,656,112 | 4/1987 | Kawagishi et al. | 430/110 |
| 4,683,188 | 7/1987 | Suzuki et al. | 430/110 |
| 4,684,596 | 8/1987 | Bonser et al. | 430/110 |
| 4,837,391 | 6/1989 | Anderson et al. | 430/110 |
| 4,840,864 | 6/1989 | Bugner et al. | 430/110 |

*Primary Examiner*—John Goodrow
*Attorney, Agent, or Firm*—Connolly and Hutz

[57] ABSTRACT

Use of colorless highly fluorine-substituted phosphonium compounds as charge control agents for electrophotographic recording processes Use of highly fluorine-substituted phosphonium compounds of the formula (I)

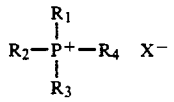

(I)

in which $R_1$ to $R_4$ are hydrogen atoms or organic radicals, at least one of the radicals $R_1$ to $R_4$ being a fluorine-substituted, unsaturated and/or saturated alkyl radical having 1 to 30 carbon atoms and 3 to 50 fluorine atoms, which can contain further substituents, or a fluorine-substituted aryl radical or an aralkyl radical which is fluorine-substituted on the aromatic ring, it being possible for the aryl or aralkyl radical to be additionally substituted on the aromatic ring, and in the case of an aralkyl radical the alkyl bridge between the phosphorus atom and the aromatic ring contains 1 to 30 carbon atoms, and not more than three of the radicals $R_1$ and $R_4$, independently of one another, are hydrogen atoms, unsaturated or saturated, substituted or unsubstituted alkyl radicals having 1 to 30 carbon atoms, aryl or aralkyl radicals which can be substituted on the aromatic ring, and $X^-$ is an anion, it being possible for the radicals $R_1$ to $R_4$ to contain a $COO^-$ or $SO_3^-$ group as substituent and $X^-$ in this case becoming superfluous, individually or in combination as colorless charge control agents having a positive or negative control effect in toners and developers for electrophotographic recording processes.

8 Claims, No Drawings

USE OF COLORLESS HIGHLY FLUORINE-SUBSTITUTED PHOSPHONIUM COMPOUNDS AS CHARGE CONTROL AGENTS FOR ELECTROPHOTOGRAPHIC RECORDING PROCESSES

INTRODUCTION

The present invention relates to the use of highly fluorine-substituted phosphonium compounds as colorless charge control agents to be employed in toners and developers for electrophotographic recording processes.

BACKGROUND OF THE INVENTION

Due to the selective introduction of fluorine-substituted organic radicals, the compounds according to the invention have particularly favorable charge control properties. In electrophotographic recording processes, a "latent charge image" is produced on a photoconductor. This can be done, for example, by charging a photoconductor by means of a corona discharge and then subjecting the electrostatically charged surface of the photoconductor to imagewise exposure, in which, as a result of the exposure, discharge to the earthed support takes place at the exposed area. The "latent charge image" thus produced is then developed by applying a toner. In a subsequent step, the toner is transferred from the photoconductor, for example, to paper, textiles, films or plastic and fixed there by pressure, radiation, heat or solvent action. The photoconductor used is then cleaned and available for the next recording process.

A large number of patent publications describe the optimization of toners, in the course of which, inter alia, the effect of the toner binder (variation of resin/resin components or wax/wax components), the effect of control agents or other additives or the effect of carriers (in the case of two-component developers) and magnetic pigments (in the case of one-component developers) were investigated.

A measure of the toner quality is its specific charge q/m (charge per mass unit). In addition to the sign and level of the electrostatic charge, an important criterion of quality is that the desired charge level is reached rapidly and maintained over a fairly long period of activation. This is of central importance in practice, since the toner in the developing mixture may be exposed to a considerable activation time before being transferred to the photoconductor, due to the fact that in some cases it remains in the developing mixture for a period necessary for producing up to several thousand copies. Moreover, a further important criterion of suitability is the insensitivity of the toner to climatic influences, such as temperature and relative humidity.

Depending on the type of the process and the apparatus, either positively or negatively chargeable toners are used in copiers and laser printers.

To obtain electrophotographic toners or developers having either a positive or negative triboelectric charge, so-called charge control agents are often added. In addition to the sign of the charge control, the extent of the control effect is important, since higher efficiency makes it possible to use a small amount.

Since toner binders alone usually show a considerable change in the charge depending on the activation time, the function of a charge control agent is on the one hand to establish the sign and level of toner charge and to counteract the charge drift of the toner binder and on the other to make sure that the toner charge remains constant. Charge control agents which are unable to prevent a high charge drift (ageing) of the toner or developer after an extended period of use, which can even have the effect that the toner or developer experiences a reversal of charge, are therefore not suitable for practical application. Full-color copiers and laser printers operate by the trichromic principle, which requires an exact color match of the three basic colors (yellow, cyan and magenta) Even if only one of the three basic colors shows a slight shift in hue, it is absolutely necessary for the two other colors to shift their hue, in order to be able to produce full-color copies and prints which are identical to the original.

Due to this precise match of the coloristics of the individual colorants required in color toners, it is of essential importance that charge control agents themselves do not have any color whatsoever.

In color toners, the three toners yellow, cyan and magenta must be matched exactly not only with respect to the exactly defined coloristic requirements but also in regard to their triboelectric properties. This triboelectric matching is necessary, because in full-color printing or in full-color copying the three color toners (or four color toners, if black is included) have to be transferred successively in the same apparatus.

Colorants are known to have a lasting effect in some cases on the triboelectric charge of toners (H.-T. Macholdt, A. Sieber, Dyes & Pigments 9 (1988), 119–27, U.S. Pat. No. 4,057,426, EP-OS 247,576). Due to the different triboelectric effects of colorants and the resulting influence on the toner chargeability, which in some cases may be very considerable, it is not possible to add them to an already prepared toner base recipe as exclusive colorant. Rather, it may become necessary to prepare an individual recipe for each colorant, for which, for example, the type and amount of the required charge control agent must be specifically tailored. Accordingly, this procedure is complicated and adds to the difficulties already described in the case of color toners for process inks (trichromatic inks).

This therefore requires highly efficient colorless charge control agents which are capable of compensating the different triboelectric behavior of various colorants and providing the toner with the desired charge. In this manner, it is possible to use triboelectrically very different colorants on the basis of an already prepared toner base recipe in combination with one and the same charge control agent in the various required toners (yellow, cyan, magenta and, where appropriate, black).

The colorless charge control agents which have been claimed for electrophotographic toners and developers are ammonium (e.g. EP-OS 203,532, EP-OS 242,420, U.S. Pat. No. 4,683,188, U.S. Pat. No. 4,684,596, JP-OS 63/226,665) and phosphonium compounds (e.g. U.S. Pat. No. 3,893,935, U.S. Pat. No. 4,496,643, JP-OS 63/231,358), metal complexes and organometallic compounds (e.g. U.S. Pat. No. 4,656,112, German Offenlegungsschrift 3,144,017, JP-OS 61/236,557, JP-OS 62/287,262) and a number of other compounds (e.g. EP-OS 216,295).

Positive colorless charge control agents essentially comprise quaternary ammonium and phosphonium compounds and some organotin and organoantimony compounds. However, the previously known colorless charge control agents have a number of disadvantages, which severely restrict or in some cases even prevent their use in practice. Thus, the quaternary ammonium compounds, which are suitable usually, are difficult to disperse, can lead to an uneven charge of the toner for reasons not yet determined, and the toner charge produced by them is not stable over a longer period of activation, in particular at elevated temperature and relative humidity (EP-OS 242,420). Furthermore, these types of compounds are sensitive to light or mechanical effects (EP-OS 203,532, U.S. Pat. No. 4,683,188) and are thermally unstable and give decomposition products which can have a disadvantageous effect on the triboelectric charge of the toners (U.S. Pat. No. 4,684,596). Some of these compounds are not really colorless and have therefore only limited use in color toners. Moreover, they often show a wax-like behavior, are in some cases water-soluble and have low efficiency as charge control agents. Phosphonium salts of the conventional type have, in addition to the disadvantages already mentioned in the case of the ammonium compounds, lower efficiency as charge control agents and poorer charge control properties (U.S. Pat. No. 4,496,643, EP-OS 161,128) than ammonium compounds (see Comparative Example 1).

Organotin borate, such as described in European Patent 216,295, and organotin (JP-OS 62/287,262) and organoantimony compounds (JP-OS 61/236,557) are problematical due to their heavy metal content.

The negative colorless charge control agents which have been disclosed include a few ammonium (JP-OS 63/226,665) and phosphonium compounds (JP-OS 63/231,358) and a number of heavy metal compounds, specifically chromium, iron, cobalt (German Offenlegungsschrift 3,144,017) and zinc complexes (U.S. Pat. No. 4,656,112, JP-OS 62/127,754). The disadvantages and restrictions already mentioned above also apply to the ammonium and phosphonium compounds.

In addition to incorporation in the toner resin, charge control agents are also used for the coating of carriers. The same classes of compounds as for the incorporation in toner resins are employed, e.g. ammonium (JP-OS 61/258,270) and phosphonium compounds (JP-OS 61/260,258) and heavy metal complexes and organometallic compounds (JP-OS 61/147,261, JP-OS 61/259,267).

It can in general be stated that colorless charge control agents are known in principle not only for positive but also for negative toners, but are suitable for practical application only to a limited extent or not at all or are still largely in need of improvement. This is also demonstrated by the fact that in particular the ammonium and phosphonium compounds have hitherto not been accepted in practice.

Accordingly, the aim of the present invention was to find improved charge control agents which are distinguished by having themselves no color whatsoever, being more effective, being suitable in particular for the use in color toners and rapidly adjusting the electrostatic charge of toners and developers as a function of concentration. Furthermore, they should maintain the electrostatic charge at a constant value over an extended period of activation (no ageing), should operate problem-free at high relative humidity and be compatible and readily dispersible with conventional toner resins.

SUMMARY OF THE INVENTION

Surprisingly, it has now been found that highly fluorine-substituted phosphonium compounds have particularly favorable properties as colorless charge control agents for electrophotographic toners and developers. Due to their lack of color, high efficiency, good compatibility and dispersibility in conventional toner resins and chemical inertness, the compounds are in particular suitable for use in color toners or color developers for full-color copiers and laser printers by the trichromatic principle (subtractive color mixing) and also for colored toners and developers in general and for black toners or developers. It is particularly surprising that substances of one and the same class of compounds are suitable, depending on the chemical modification, either as positive or as negative charge control agents (see Working Examples 1 to 4). Furthermore, the compounds are also suitable for the coating of carriers.

A great technical advantage of these readily dispersible compounds is that substances of the same class of compounds can be used either as positive or negative control agent. This minimizes difficulties during the incorporation in the toner binder and the compatibility with the toner binder after preparation of a toner base recipe. Thus positive and also negative toners can be prepared on the basis of a fixed toner base recipe (consisting of toner binder, colorant, flow-improving agent and, if desired, further components) by incorporation of the desired control agent.

The synthesis of fluorine-substituted phosphonium compounds is known and described, for example, in J. Chem. Soc., Chem. Commun. 1984, 1233–34, Chem. Ber. 114 (1981), 3589–3598, J. Fluorine Chem. 23 (1983), 339 and in German Offenlegungsschrift 2,936,211. These types of compounds are used, for example, as precursors for Wittig ylids, as precursors for fluorine-substituted styrenes or as surface-active substances. However, their use as charge control agents in electrophotographic toners and developers is completely new.

The present invention relates to the use of highly fluorine-substituted phosphonium compounds of the general formula (I)

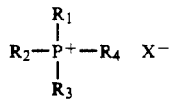

(I)

in which $R_1$ to $R_4$ are hydrogen atoms or organic radicals, at least one of the radicals $R_1$ to $R_4$ being a straight-chain or branched, fluorine-substituted, unsaturated and/or saturated alkyl radical having 1 to 30 carbon atoms and 3 to 50 fluorine atoms, which can contain further halogen atoms, such as fluorine, chlorine, bromine or iodine atoms, hydroxyl and/or chloromethyl and/or carboxamide and/or sulfonamide and/or urethane and/or keto and/or amino and/or $R_5$-O-$R_6$ and/or $R_7$-C(O)-O-$R_8$ groups in which $R_5$, $R_6$, $R_7$ and $R_8$ are alkyl ($C_1$–$C_{30}$) radicals, or a fluorine-substituted aryl radical, such as, for example, a phenyl, toluyl or naphthyl radical, or an aralkyl radical fluorine-substituted on the aromatic ring, such as, for example, a benzyl radical, it being possible for the aryl or aralkyl radical to be additionally substituted on the aromatic ring by saturated or unsaturated, straight-chain or branched alkyl((-

$C_1$-$C_{30}$), alkoxy(($C_1$-$C_{30}$), halogenoalkyl(($C_1$-$C_{30}$), preferably fluoroalkyl(($C_1$-$C_{30}$), halogenoalkoxy(($C_1$-$C_{30}$), preferably fluoroalkoxy(($C_1$-$C_{30}$), or hydroxyl groups or further halogen atoms, such as, for example, chlorine, bromine or iodine atoms, and in the case of an aralkyl radical the alkyl bridge between the phosphorus atom and the aromatic ring contains 1 to 30 carbon atoms, and no more than three of the radicals $R_1$ to $R_4$, independently of one another, are hydrogen atoms, straight-chain or branched, unsaturated or saturated, substituted or unsubstituted alkyl radicals having 1 to 30 carbon atoms, aryl radicals, such as, for example, phenyl, toluyl or naphthyl radicals, aralkyl radicals, for example benzyl radicals, it being possible for the aryl or aralkyl radicals to be substituted on the aromatic ring by alkyl(($C_1$-$C_{30}$), alkoxy(($C_1$-$C_{30}$), halogenoalkyl(($C_1$-$C_{30}$), halogenoalkoxy(($C_1$-$C_{30}$) or hydroxyl groups or halogen atoms, such as, for example, fluorine, chlorine, bromine or iodine atoms, and X is an organic or inorganic anion, it being possible for the radicals $R_1$ to $R_4$ to contain a $COO^-$ or $SO_3^-$ group as substituent and $X^-$ in this case becoming superfluous, individually or in combination as colorless charge control agents having a positive or negative control effect in toners and developers for electrophotographic recording processes.

Examples of $X^-$ as inorganic or organic anion can be $Hal^-$, such as, for example, $F^-$, $Cl^-$, $Br^-$ or $I^-$, furthermore $PF_6^-$, sulfate, phosphate, cyanate, thiocyanate, $BF_4^-$, $B(aryl)_4^-$, such as, for example, tetraphenyl borate, p-chlorotetraphenyl borate, p-methyltetraphenyl borate, tetranaphthyl borate, furthermore phenolate, nitrophenolate, tetracyanatozincate, tetrathiocyanatozincate, $CH_3OSO_3^-$, saturated or unsaturated aliphatic or aromatic carboxylate or sulfonate, such as, for example, acetate, lactate, benzoate, salicylate, 2-hydroxy-3-naphthoate, 2-hydroxy-6-naphthoate, ethylsulfonate, phenylsulfonate, furthermore perfluorinated saturated or unsaturated, aliphatic or aromatic carboxylate or sulfonate, such as, for example, perfluoroacetate, perfluoroalkylbenzoate, perfluoroethylsulfonate or perfluoroalkylbenzenesulfonate.

DESCRIPTION OF PREFERRED EMBODIMENT

The phosphonium compounds of the abovementioned general formula (I) can be used by themselves or in combination in toners or developers which are used for the electrophotographic copying or duplication of originals and for the printing of electronically, optically or magnetically stored information or in color proofing. Furthermore, these compounds can be used for the coating of carriers and in powders and paints for surface coating, in particular in electrokinetically sprayed powder coatings, as charge-improving agents and are effective as dispersing aids.

Compounds of the said general formula (I) in which at least one of the radicals $R_1$ to $R_4$ is a straight-chain or branched, fluorine-substituted, unsaturated and/or saturated alkyl radical having 4 to 17 carbon atoms and 3 to 25 fluorine atoms, which can contain further halogen atoms, such as fluorine, chlorine, bromine or iodine atoms, hydroxyl and/or chloromethyl and/or carboxamide and/or urethane and/or keto and/or amino and/or $R_5$-O-$R_6$ and/or $R_7$-C(O)-O-$R_8$ groups in which $R_5$, $R_6$, $R_7$ and $R_8$ are alkyl ($C_1$-$C_{18}$) radicals, or a fluorine-substituted aryl radical, such as, for example, phenyl, toluyl or naphthyl radical, or an aralkyl radical which is fluorine-substituted on the aromatic ring, such as, for example, a benzyl radical, it being possible for the aryl or aralkyl radical to be additionally substituted on the aromatic ring by saturated or unsaturated, straight-chain or branched alkyl($C_1$-$C_{18}$), alkoxy($C_1$-$C_{18}$), halogenoalkyl($C_1$-$C_{18}$), preferably fluoroalkyl($C_1$-$C_{18}$), halogenoalkoxy($C_1$-$C_{18}$), preferably fluoroalkoxy($C_1$-$C_{18}$), or hydroxyl groups or further halogen atoms, such as, for example, chlorine, bromine or iodine atoms, and in the case of an aralkyl radical the alkyl bridge between the phosphorus atom and the aromatic ring contains 1-18 carbon atoms, preferably 1 to 5 carbon atoms, and no more than three of the radicals $R_1$ to $R_4$, independently of one another, are hydrogen atoms, straight-chain or branched, unsaturated or saturated, substituted or unsubstituted alkyl radicals having 1 to 18 carbon atoms, aryl radicals, such as, for example, phenyl, toluyl or naphthyl radicals, or aralkyl radicals, such as, for example, benzyl radicals, it being possible for the aryl or aralkyl radicals to be substituted on the aromatic ring by alkyl($C_1$-$C_{18}$), alkoxy($C_1$-$C_{18}$), halogenoalkyl($C_1$-$C_{18}$), halogenoalkoxy($C_1$-$C_{18}$), or hydroxyl groups or fluorine, chlorine, bromine or iodine atoms, and $X^-$ is an organic or inorganic anion, it being possible for the radicals $R_1$ to $R_4$ to contain a $COO^-$ or $SO_3^-$ group as substituent and $X^-$ in this case becoming superfluous, are particularly suitable.

Compounds of the said general formula (I) in which no more than three of the radicals $R_1$ to $R_4$ are a phenyl group and at least one of the radicals $R_1$ to $R_4$ a group from the series comprising $C_8F_{17}$-$CH_2$-$CH_2$- and Rf-$CH_2$-$CH_2$-(Rf=$C_6F_{13}$ to $C_{12}F_{25}$), and $X^-$ is $BF_4^-$, $Hal^-$, such as, for example, $F^-$, $Cl^-$, $Br^-$, $I^-$, or is $PF_6^-$, $B(aryl)_4^-$, such as, for example, tetraphenyl borate or p-chlorotetraphenylborate, p-methyltetraphenylborate or tetranaphthyl-borate are especially suitable.

Examples of individual compounds or mixtures of compounds of the general formula (I) mentioned are:

$$C_8F_{17}-CH_2-CH_2-\overset{+}{P}(phenyl)_3 \qquad PF_6^- \tag{1}$$

$$C_8F_{17}-CH_2-CH_2-\overset{+}{P}(phenyl)_3 \qquad B(phenyl)_4^- \tag{2}$$

$$C_8F_{17}-CH_2-CH_2-\overset{+}{P}(phenyl)_3 \qquad B(p\text{-}toluyl)_4^- \tag{3}$$

$$C_8F_{17}-CH_2-CH_2-\overset{+}{P}(phenyl)_3 \qquad I^- \tag{4}$$

$$C_8F_{17}-CH_2-CH_2-CH_2-CH_2-\overset{+}{P}(phenyl)_3 \qquad I^- \tag{5}$$

-continued $C_{10}F_{21}-CH_2-CH_2-CH_2-CH_2-\overset{+}{P}(phenyl)_3$ $I^-$ (6)

$Rf-CH_2-CH_2-\overset{+}{P}(phenyl)_3$ $I^-$ (7)
(Rf = $C_6F_{13}$ to $C_{12}F_{25}$)

$CF_2{=}CF-CH_2-CH_2-\overset{+}{P}(phenyl)_3$ $Br^-$ (8)

$CF_2{=}CF-CH_2-CH_2-CH_2-CH_2-\overset{+}{P}(phenyl)_3$ $Br^-$ (9)

$CF_2Br-CFCl-CH_2-CH_2-\overset{+}{P}-(phenyl)_3$ $Br^-$ (10)

$CF_2Br-CFCl-CH_2-CH_2-CH_2-CH_2-\overset{+}{P}(phenyl)_3$ $Br^-$ (11)

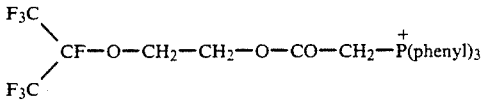
$Br^-$ (12)

$Rf-CH_2-CH_2-\overset{+}{P}(CH_2OH)_3$ $J^-$ (13)
(Rf = $C_6F_{13}$ to $C_{12}F_{25}$)

$Rf-CH_2-CH_2-\overset{+}{P}(CH_2-CH_2-CN)_3$ $J^-$ (14)
(Rf = $C_6F_{13}$ to $C_{12}F_{25}$)

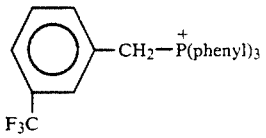
$Cl^-$ (15)

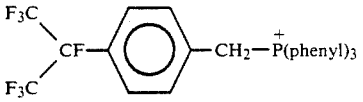
$Cl^-$ (16)

(In some of the preparation and working examples, reference is made to various of the compounds listed above).

For example, a toner containing 1.0% by weight of compound (1) has charge of +18.5 μC/g after 10 minutes and +19.3 μC/g after 24 hours of activation time (see Working Example 1 of the working examples below). A toner containing 1.0% by weight of compound (2) has a charge of −2.8 μC/g after 10 minutes and −2.7 μC/g after 24 hours of activation time (Working Example 2).

The compounds of the general formula (I) mentioned can also be applied from suitable media, such as, for example, solutions, to suitable substrates, such as, for example, silica gel, alumina, titanium dioxide. As a rule, the compounds used according to the invention are incorporated homogeneously in the particular substrate in a concentration of about 0.01 to about 10% by weight, preferably about 0.1 to about 5.0% by weight, in a known manner for example by kneading or extruding. The charge control agents for toners or charge-improving agents for powders and paints for surface coating, in particular for electrokinetically sprayed powder coatings, can be added in the form of dried or ground powders, dispersants or solutions, presscakes, masterbatches, in the form of compounds applied to suitable substrates from aqueous or non-aqueous solution or in any other form. Likewise, the compounds used according to the invention can in principle also already be added when the particular binder is prepared, i.e. during the polymerization or polycondensation. Typical toner binders are, for example, styrene, styrene/acrylate, styrene/butadiene, acrylate, polyester, 'amide, amine, ammonium, ethylene, phenol and epoxy resins, individually or in combination, which can also contain further components, such as colorants, waxes or flow-improving agents or to which these components can be added afterwards. Typical substrates (resins) for powders and paints for surface coating, in particular for electrokinetically sprayed powder coatings, are, for example, epoxy resins, carboxyl- and hydroxyl-containing polyester resins and acrylic resins together with curing agents, such as, for example, acid anhydrides, imidazoles, melamine or phenolic resins.

The magnitude of the electrostatic charge of the electrophotographic toners in which the charge control agents claimed according to the invention have been incorporated homogeneously was measured, using standard testing systems under identical conditions, (such as identical dispersing times, identical particle size distribution, identical particle shape) at room temperature and 50% relative humidity. The activation of the toner in a two-component developer was carried out by thorough mixing with a carrier (3 parts by weight of toner per 97 parts by weight of carrier) on a roller stand (150 revolutions per minute). The electrostatic charge was then measured on a conventional q/m measuring system (cf. J.H. Dessauer, H.E. Clark, "Xerography and related Processes", Focal Press, N.Y. 1965, page 289). The particle size has a considerable effect on the measurement of the q/m value; that is why the toner specimens obtained by screening were carefully checked for uniform particle size distribution.

The examples below serve to illustrate the invention without limiting it thereto. The parts given are by weight.

PREPARATION EXAMPLE 1

8.4 g (0.01 mol) of $C_8F_{17}$-$CH_2$-$CH_2$-$P^+$(phenyl)$_3I^-$ (molecular weight 836, preparation described in J. Chem. Soc., Chem. Commun., 1984, 1233-34) are dissolved in 150 ml of water/isopropanol (1:1 parts by volume), and 1.9 g (0.01 mol) of potassium hexafluorophosphate are then added slowly with stirring. The mixture is then made up to 400 ml with water/isopropanol and heated at the boiling temperature for 30 minutes. The white precipitate is filtered off with suction while hot, washed with water/isopropanol and dried in vacuo at 50° C.

Yield: 7.9 g (92.5% of theory) of compound (1)

Molecular wt.: 854

Melting point: 176°-177° C.

Elemental analysis: calculated; 39.3% C, 2.2% H, 51.2% F, 7.3% P; found; 39.1% C, 2.1% H, 51.7% F, 6.9% P; 0.18% of water 1H-NMR (in DMSO-$d_6$): 2.62 (Multiplet, 2 methylene H), 4.06 (Multiplet, methylene H), 7.85 (Multiplet, 15 phenyl H) ppm.

PREPARATION EXAMPLE 2

Compound (2) is prepared by repeating the procedure of Preparation Example 1, except that 3.4 g (0.01 mol) of sodium tetraphenylborate are used instead of potassium hexafluorophosphate.

Yield: 9.3 g (90.5% of theory) of compound (2)

Molecular wt.: 1028

Melting point: 169°-170° C.

Elemental analysis: calculated; 60.7% C, 3.8% H, 3.0% P, 1.1% B; found; 60.7% C, 3.7% H, 3.0% P, 0.9% B; 0.06% of water 1H-NMR (in DMSO-$d_6$): 2.58 (Multiplet, 2 methylene H), 4.02 (Multiplet, 2 methylene H), 7.00 (Multiplet, 20 phenyl H of the tetraphenylborate anion), 7.83 (15 phenyl H of the phosphonium cation) ppm.

PREPARATION EXAMPLE 3

Compound (3) is prepared by repeating the procedure of Preparation Example 1, except that 4.0 g (0.01 mol) of sodium tetra-p-toluylborate are used instead of potassium hexafluorophosphate.

Yield: 9.7 g (89.5% of theory) of compound (3)

Molecular wt.: 1084

Melting point: 189°-190° C.

Elemental analysis: calculated; 62.0% C, 4.3% H, 2.9% P, 1.0% B; found; 62.1% C, 4.2% H, 2.4% P, 0.9% B; 0.07% of water 1H-NMR (in DMSO-$d_6$): 2.14 (Singlet, 3 toluyl H), 2.60 (Multiplet, 2 methylene H), 3.99 (Multiplet, 2 methylene H), 6.88 (Multiplet, 16 p-toluyl H), 7.82 (Multiplet, 15 phenyl H of the phosphonium cation) ppm.

WORKING EXAMPLE 1

1.0 part of compound (1) was incorporated in 99.0 parts of toner binder (Dialec S 309 from Diamond Shamrock, styrene-methacrylate copolymer 60:40) homogeneously for 45 minutes by means of a kneader from Werner & Pfleiderer (Stuttgart). The mixture was then milled on a laboratory universal mill 100 LU (from Alpine, Augsburg) and then classified on a centrifugal screener 100 MZR (from Alpine). The desired particle fraction (4-25 μm) was activated, using carrier consisting of magnetite particles of the size 50 to 200 μm of the type 90 μm xerographic carrier from Plasaa Materials Inc. (Manchester, N.H., USA) coated with styrene-methacrylate copolymer 90:10.

The measurement was carried out using a conventional q/m measuring system (from Epping GmbH, Neufahrn); by using a screen having a mesh width of 25 μm (from Gebr. Kufferath, Düren), it was ensured that no carrier could be entrained by the blown-out toner. The following q/m values (μC/g) were measured as a function of activation time:

| Activation time | q/m (μC/g) 50% relative humidity |
|---|---|
| 10 min. | +18.5 |
| 30 min. | +18.4 |
| 2 hours | +20.4 |
| 24 hours | +19.3 |

WORKING EXAMPLE 2

The procedure described in Working Example 1 was repeated, except that 1.0 part of compound (2) was incorporated homogeneously in 99.0 parts of toner binder.

| Activation time | q/m (μC/g) 50% relative humidity |
|---|---|
| 10 min | −2.8 |
| 30 min. | −2.3 |
| 2 hours | −1.9 |
| 24 hours | −2.7 |

WORKING EXAMPLE 3

The procedure described in Working Example 1 was repeated, except that 2.5 parts of compound (2) were incorporated homogeneously in 97.5 parts of toner binder.

| Activation time | q/m (μC/g) 50% relative humidity |
|---|---|
| 10 min. | −5.4 |
| 30 min. | −3.9 |
| 2 hours | −4.2 |
| 24 hours | −6.5 |

WORKING EXAMPLE 4

The procedure described in Working Example 1 was repeated, except that 0.5 part of compound (3) was incorporated homogeneously in 99.5 parts of toner binder.

| Activation time | q/m (μC/g) 50% relative humidity |
|---|---|
| 10 min. | −17.0 |
| 30 min. | −16.1 |
| 2 hours | −14.1 |

-continued

| Activation time | q/m (μC/g) 50% relative humidity |
|---|---|
| 24 hours | −13.2 |

COMPARATIVE EXAMPLE 1

The procedure described in Working Example 1 was repeated, except that 1.0 part of tetramethylphosphonium chloride was incorporated homogeneously in 99.0 parts of toner binder.

| Activation time | q/m (μC/g) 50% relative humidity |
|---|---|
| 10 min. | +5.4 |
| 30 min. | +2.5 |
| 2 hours | −1.8 |
| 24 hours | −4.4 |

We claim

1. A method for effecting in toners and developers a positive or negative charge control effect (for electrophotogrpahic recording processes) comprising the step of incorporating the compounds of the formula (I)

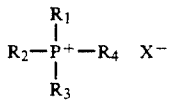

(I)

in which $R_1$ to $R_4$ are hydrogen atoms or organic radicals, at least one of the radicals $R_1$ to $R_4$ being a straight-chain or branched, fluorine-substituted, unsaturated and/or saturated alkyl radical having 1 to 30 carbon atoms and 3 to 50 fluorine atoms, which can contain further halogen atoms, hydroxyl and/or chloromethyl and/or carboxamide and/or sulfonamide and/or urethane and/or keto and/or amino and/or $R_5$-O-$R_6$ and/or $R_7$-C(O)-O-$R_8$ groups in which $R_5$, $R_6$, $R_7$ and $R_8$ are alkyl ($C_1$–$C_{30}$) radicals, or a fluorine-substituted aryl radical, or an aralkyl radical fluorine-substituted on the aromatic ring, it being possible for the aryl or aralkyl radical to be additionally substituted on the aromatic ring by saturated or unsaturated, straight-chain or branched alkyl($C_1$–$C_{30}$), alkoxy($C_1$–$C_{30}$), halogenalkyl, halogenoalkoxy-($C_1$–$C_{30}$), or hydroxyl groups or further halogen atoms, and in the case of an aralkyl radical the alkyl bridge between the phosphorus atom and the aromatic ring contains 1 to 30 carbon atoms, and no more than three of the radicals $R_1$ to $R_4$, independently of one another, are hydrogen atoms, straight-chain or branched, unsaturated or saturated, substituted or unsubstituted alkyl radicals having 1 to 30 carbon atoms, aryl radicals or aralkyl radicals, it being possible for the aryl or aralkyl radicals to be substituted on the aromatic ring by alkyl($C_1$–$C_{30}$), alkoxy($C_1$–$C_{30}$), halogenalkyl($C_1$–$C_{30}$), halogenoalkoxy($C_1$–$C_{30}$) or hydroxyl groups or halogen atoms, and X is an organic or inorganic anion, it being possible for the radicals $R_1$ to $R_4$ to contain a COO or $SO_3$ group as substitutent and X in this case becoming superfluous, including the step of providing said compounds as colorless charge control agents having a positive or negative control effect in toners and developers for electrophotographic recording processes.

2. A method as claimed in claim 1, wherein in the formula (I) of claim 1 at least one of the radicals $R_1$ to $R_4$ is a straight-chain or branched, fluorine-substituted, unsaturated and/or saturated alkyl radical having 4 to 17 carbon atoms and 3 to 25 fluorine atoms, which can contain further halogen atoms, hydroxyl and/or chloromethyl and/or carboxamide and/or urethane and/or keto and/or amino and/or $R_5$-O-$R_6$ and/or $R_7$-C(O)-)-$R_8$ in which $R_5$, $R_6$, $R_7$ and $R_8$ are alkyl ($C_1$–$C_{18}$) radicals, or a fluorine-substituted aryl radical, or an aralkyl radical which is fluorine-substituted on the aromatic ring, it being possible for the aryl or aralkyl radical to be additionally substituted on the aromatic ring by saturated or unsaturated, straight-chain or branched alkyl($C_1$–$C_{18}$), alkoxy($C_1$–$C_{18}$), halogenoalkyl-($C_1$–$C_{18}$), halogenoalkoxy($C_1$–$C_{18}$), or hydroxyl groups or fluorine, chlorine, bromine or iodine atoms, and in the case of an aralkyl radical the alkyl bridge between the phosphorus atom and the aromatic ring contains 1–18 carbon atoms, and no more than three of the radicals $R_1$ to $R_4$, independently of one another, are hydrogen atoms, straight-chain or branched, unsaturated or saturated, substituted or unsubstituted alkyl radicals having 1 to 18 carbon atoms, aryl radicals or aralkyl radicals, it being possible for the aryl or aralkyl radicals to be substituted on the aromatic ring by alkyl($C_1$–$C_{18}$), alkoxy($C_1$–$C_{18}$), halogenoalkyl($C_1$–$C_{18}$), halogenoalkoxy($C_1$–$C_{18}$), or hydroxyl groups or fluorine, chlorine, bromine or iodine atoms, and $X^-$ is an organic or inorganic anion, it being possible for the radicals $R_1$ to $R_4$ to contain a $COO^-$ or $SO_3^-$ group as substituent and $X^-$ in this case becoming superfluous.

3. A method as claimed in claim 1, wherein in the formula (I) of claim 1 $X^-$ is $F^-$, $Cl^-$, $Br^-$, $I^-$, $PF_6^-$, sulfate, phosphate, cyanate, thiocyanate, $BF_4^-$, tetraphenylborate, p-chlorotetraphenylborate, p-methyltetraphenylborate, tetranaphthylborate, phenolate, nitrophenolate, tetracyanatozincate, tetrathiocyanatozincate, $CH_3OSO_3^-$, saturated or unsaturated aliphatic or aromatic carboxylate or sulfonate, perfluorinated saturated or unsaturated aliphatic or aromatic carboxylate or sulfonate.

4. A method as claimed in claim 1, wherein in the formula (I) of claim 1 not more than three of the radicals $R_1$ to $R_4$ are a phenyl group and at least one of the radicals $R_1$ to $R_4$ is a group from the series comprising $C_8F_{17}$-$CH_2$-$CH_2$- and Rf-$C_2$-$CH_2$- (Rf=$C_6F_{13}$ to $C_{12}F_{25}$), and $X^-$ is $BF_4^-$, $F^-$, $Cl^-$, $Br^-$ and $I^-$, $PF_6^-$, tetraphenylborate, p-chlorotetraphenylborate, p-methyltetraphenylborate or tetranaphthylborate.

5. A method as claimed in claim 1, wherein the phosphonium compounds of the formula (I) of claim 1, individually or in combination, are used in a concentration of about 0.01 to about 10 per cent by weight.

6. A method for preparing toners or developers applicable for the electrophotographic copying or duplication of originals and for the printing of electronically, optically or magnetically stored information or the color proofing comprising the step of incorporating a compound of the formula (I) of claim 1, individually or in combination, into the toners or developers.

7. A method for coating carriers applicable for developers for the electrophotographic copying or duplication of originals and for the printing of electronically, optically or magnetically stored information or the color proofing comprising the step of coating the carriers with the compounds of the formula (I) of claim 1, individually or in combination.

8. A method for surface-coating of objects of metal, wood, resin, glass, ceramic, concrete, textile material, paper or rubber comprising the step of incorporating a compound of the formula (I) of claim 1, individually or in combination, as a charge improving (enhancing) agent into powders and paints, in particular in electrokinetically sprayed powder coatings.

* * * * *

UNITED STATES PATENT AND TRADEMARK OFFICE

CERTIFICATE OF CORRECTION

PATENT NO. : 5,147,748

DATED : September 15, 1992

INVENTOR(S) : Jorg Gitzel, et. al.

It is certified that error appears in the above-indentified patent and that said Letters Patent is hereby corrected as shown below:

Claim 2, column 12, lines 3 and 4, delete the following:

"$R_7$-C(O)-)-$R_8$" and substitute the following:

-- $R_7$-C(O)-O-$R_8$ --

Signed and Sealed this

Twenty-eighth Day of September, 1993

Bruce Lehman

*Attest:*

BRUCE LEHMAN

*Attesting Officer*

*Commissioner of Patents and Trademarks*